United States Patent [19]

Eder et al.

[11] 4,447,706

[45] May 8, 1984

[54] NOZZLE ASSEMBLY WITH INTEGRATED PTC HEATER FOR PREWARMING FUEL OIL

[75] Inventors: Werner Eder; Gisbert Fischer, both of Dauchingen, Fed. Rep. of Germany

[73] Assignee: Danfoss A/S, Nordborg, Denmark

[21] Appl. No.: 413,081

[22] Filed: Aug. 30, 1982

Related U.S. Application Data

[63] Continuation of Ser. No. 133,893, Mar. 25, 1980, abandoned.

[30] Foreign Application Priority Data

Mar. 27, 1979 [DE] Fed. Rep. of Germany ..... 2912000
Jul. 31, 1979 [DE] Fed. Rep. of Germany ..... 2930996

[51] Int. Cl.[3] ..... F23D 11/44; F02M 31/12; H05B 1/02; H05B 3/14

[52] U.S. Cl. ..... 219/299; 48/103; 123/549; 123/557; 137/341; 219/206; 219/298; 219/301; 219/302; 219/328; 219/505; 431/11; 431/41; 431/208

[58] Field of Search ..... 219/296–299, 219/301, 302, 328, 504, 505, 530, 540, 206, 207; 138/33; 137/341; 431/11, 41, 207, 208, 28; 123/557, 549; 222/146 HE, 146 R; 48/103; 261/142

[56] References Cited

U.S. PATENT DOCUMENTS

| | | | |
|---|---|---|---|
| 1,420,840 | 6/1922 | Hewitt | 219/299 X |
| 1,456,907 | 5/1923 | Penton | 219/298 |
| 1,696,758 | 12/1928 | Galdi et al. | 219/299 |
| 1,749,401 | 3/1930 | Tidy . | |
| 2,225,869 | 12/1940 | Janitschek | 219/301 |
| 3,139,518 | 6/1964 | Gardener | 219/301 X |
| 3,501,619 | 3/1970 | Buiting | 219/301 X |
| 3,927,300 | 12/1975 | Wada et al. | 219/307 |
| 4,038,022 | 7/1977 | Blackman | 431/166 |
| 4,106,891 | 8/1978 | Schladitz | 219/299 X |
| 4,177,375 | 12/1979 | Meixner | 219/296 |
| 4,354,822 | 10/1982 | Madsen et al. | 219/301 X |
| 4,371,778 | 2/1983 | Meixner et al. | 219/302 |

FOREIGN PATENT DOCUMENTS

| | | | |
|---|---|---|---|
| 2263020 | 7/1973 | Fed. Rep. of Germany . | |
| 2504237 | 8/1976 | Fed. Rep. of Germany . | |
| 2614433 | 10/1976 | Fed. Rep. of Germany . | |
| 2719573 | 5/1978 | Fed. Rep. of Germany . | |
| 7811098 | 8/1978 | Fed. Rep. of Germany . | |
| 7730201 | 3/1979 | Fed. Rep. of Germany . | |
| 7730233 | 3/1979 | Fed. Rep. of Germany . | |
| 2804749 | 8/1979 | Fed. Rep. of Germany | 219/301 |
| 2804818 | 8/1979 | Fed. Rep. of Germany | 219/301 |
| 2821207 | 11/1979 | Fed. Rep. of Germany . | |
| 474808 | 11/1937 | United Kingdom | 219/299 |

OTHER PUBLICATIONS

"PTC–Thermistoren A/S Selbstregelnde Heizelemente," by E. Andrich, Philips Technisch. Rundshav, 30, 1969/70, No. 6/7, pp. 192–200.

"Self–Regulating PTC Heating Systems: A New Approach for Heating Appliances," by Youn H. Ting; IEEE Transactions on Industry Applications, vol. IA–8, No. 3, May/Jun. 1973, pp. 338–344.

*Primary Examiner*—A. Bartis

*Attorney, Agent, or Firm*—Wayne B. Easton

[57] ABSTRACT

An oil burner system includes a burner nozzle connected to a supply of fuel oil by a nozzle assembly having integrated therein an electric heater for prewarming the oil fed to the nozzle. The nozzle assembly has first connector at one end directly connected to the burner nozzle and a second connector at its other end directly connected to an oil supply conduit. The preheater comprises an elongated rectangular PTC heating resistor having a pair of parallel sides of greater width than the thickness of the resistor and coextensive electrical contacts extending longitudinally and transversely in electrical engagement with the parallel sides. A pair of parallel flattened thin wall metal conduit sections extend coextensively between the first and second connectors and define thin unimpeded generally rectangular cross section flow path for the oil to be heated. The conduit sections sandwich the PTC resistor therebetween with the parallel sides of the resistor and flattened conduit surfaces in direct heat conductive relationship whereby the self-regulation of the heating output of the PTC resistor following the heating oil temperature with very little time lag.

1 Claim, 15 Drawing Figures

NOZZLE ASSEMBLY WITH INTEGRATED PTC HEATER FOR PREWARMING FUEL OIL

This is a continuation application of Ser. No. 133,893, filed Mar. 25, 1980, now abandoned.

BACKGROUND OF THE INVENTION

The invention relates to an apparatus for prewarming heating oil ahead of the nozzle of a burner having a PTC resistor with electric current flowing through it which is in heat-conductive contact with a line carrying the heating oil to the nozzle.

Oil burners of low and minimum output have substantial advantages in many applications. With burners of this kind, it is possible to adapt the heat output to relatively low requirements as well, such as are found in heating systems for single floors of a building or for single rooms. The low burner output makes it possible to use a smaller container, which thus is less expensive and saves space. The heat insulation of the container is more favorable, and temperature regulation of the container can be attained with fewer startups of the burner, with the result that there is less soiling of the burner and less impact on the environment.

The essential problem with oil burners of minimum output resides in the small cross sections of the nozzle ducts. The narrowness of the nozzle ducts produces poor consistency in the oil throughput and frequently causes the ducts to become plugged.

It is known to repond to these disadvantages by prewarming the heating oil ahead of the nozzle. This prewarming reduces the viscosity of the oil, and satisfactory atomization can be attained at a lower atomization pressure. The lower pressure causes a reduced oil throughput and a lower burner output. In addition, the reduced viscosity lessens the danger of plugging. On the other hand, if it is not desired to reduce the oil throughput and accordingly the burner output, then the cross section of the nozzle ducts can be enlarged because of the reduced atomization pressure. In this case, a substantial lessening of the danger of plugging, and thus an increase in the reliability of the burner, are attained.

To prewarm the heating oil, it is known to use an electric resistance heating means. Electric resistance heating has the disadvantage of requiring a large amount of space. A still more serious disadvantage is that electric resistance heating can cause overheating of the oil beyond the optimum temperature, which may be 70°–80° C., for example, expecially when the burner is shutting off or when the flow velocity of the oil is reduced. Overheating can cause undesirable cracking of the heating oil.

These disadvantages of electric resistance heating are avoided by means of the apparatus known from the German Design Application No. 78 11 098. In this apparatus, a PTC resistor with electrical current flowing through it is used to prewarm the heating oil. The PTC resistor has the property of regulating its own heat output in a known manner. This self-regulation prevents overheating of the heating oil, without expensive additional control measures being necessary.

In this known apparatus, the PTC resistor element is inserted radially into a heat-conductive, metallic sleeve which surrounds the line carrying the heating oil. The effectiveness of this prewarming apparatus is extremely poor, because on the one hand the electrical insulation necessarily disposed between the PTC resistor element and the metallic sleeve also acts as a heat resistor, while on the other hand the metallic sleeve, because of its large surface area, causes high heat losses. Finally, the metallic sleeve has a high heat capacity, so that the self-regulation of the PTC resistor element functions sluggishly and overheating of the heating oil is not reliably precluded. A further disadvantage is that the apparatus, which is placed externally on the oil supply line, requires a substantial amount of space, so that it cannot be put to use without structural alteration of the entire burner.

OBJECTS AND SUMMARY OF THE INVENTION

It is accordingly a principal object of the invention to improve an apparatus for prewarming heating oil of the type discussed above in such a manner that preheating takes place at a high level of effectiveness, that the self-regulation of the PTC resistor element functions practically without delay, and that the apparatus can be integrated in a space-saving manner in the nozzle assembly of the burner and can thus be used without alteration of the burner structure.

This object is attained according to the invention by inserting at least one plate-like PTC resistor element into the cross section of the nozzle assembly of the burner, by embodying the line carrying the heating oil as at least one flat duct in the region of the PTC resistor element, and by having at least one flat side of the PTC resistor element resting with heat contact against a wall of this flat duct.

Advantageous forms of embodiment and variants of the invention are disclosed in the dependent claims.

In the apparatus according to the invention, the PTC resistor element, embodied as plate-like, is seated in the cross section of the nozzle assembly, and the supply line for the heating oil is embodied as a duct whose flat side rests against the entire flat side of the PTC resistor element. The apparatus can therefore be entirely integrated into the nozzle assembly of the burner, with only the electrical connection lines of the PTC resistor element needing to be carried outside the nozzle assembly. The apparatus accordingly does not necessitate any structural alterations in the burner and can be used without difficulty in already existing furnace structures.

The direct heat contact over a large surface area between the PTC resistor element and the heating oil results in an optimal level of prewarming effectiveness. Because no elements having heat capacity are located between the PTC resistor element and the heating oil, the self-regulation of the PTC resistor element functions practically free of delay. The heating oil is therefore always held at the optimal prewarming temperature, and overheating is reliably precluded.

Safety regulations require that the heating oil temperature under no circumstances exceed 95° C. This requirement cannot be met in all cases with absolute reliability by the self-regulating property of the PTC resistor element alone, because the electrical data of the PTC resistor elements exhibit a certain diversity resulting from conditions of production, and the heat capacity and heat conductance of the entire apparatus are likewise subject to certain production tolerances. According to the invention, a safety thermostat is therefore used to supplement the self-regulating action of the PTC resistor element; the safety thermostat interrupts the supply of electric current to the PTC resistor element as soon as the heating oil exceeds the maximum permissible temperature.

In an advantageous manner, a control thermostat can also be additionally used, as is known per se in combination with other types of prewarming, such as electrical resistance heating. A control thermostat of this kind, disposed in the burner control circuit, closes an electrical contact upon the attainment of a predetermined minimum oil temperature, as a result of which the oil burner can be put into operation. This prevents startup of the burner when the oil temperature is too low. In like fashion, the control themostat opens the electrical contact when the oil temperature falls below the predetermined minimum temperature and shuts the burner off. As a result, sooting of the container, which would occur at an excessively low oil temperature, is prevented.

The safety thermostat and the control thermostat are disposed in direct, heat-conductive contact over a large surface area with the flat ducts carrying the heating oil and in which the prewarming of the oil occurs by means of the PTC resistor elements. The safety thermostat and the control thermostat can thus also be integrated into the cross section of the nozzle assembly and they do not change its dimensions, which are such as to be advantageous for its installation in the burner. The heat-conductive contact over a large surface area results in a virtually inertia-free determination of the actual heating oil temperature by the thermostats, directly at the location at which the heating oil is warmed by the PTC resistor elements. The safety thermostat thus responds without significant hesitation to the actual maximum temperature attained in the entire oil supply line as a result of the preheating. Reliable observation of the prescribed maximum temperature is thus assured for the entire oil supply system.

Further advantages and features of the invention will become apparent from the ensuing description of preferred exemplary embodiments illustrated in the drawings.

BRIEF DESCRIPTION OF THE DRAWINGS

Prior to referring to specific embodiments of the invention, reference is made to the prior art type of nozzle assembly shown in FIG. 15. In FIG. 15 the nozzle assembly comprises a preheater unit 100 which includes a cylindrical casing 24 connected at one end to a nozzle 12A with a connector 12 and connected at the other end with a nozzle shank 10A with a connector 10. The nozzle assembly is shown connected to a fuel oil supply.

DESCRIPTION OF THE PREFERRED EMBODIMENTS

Figure 1:
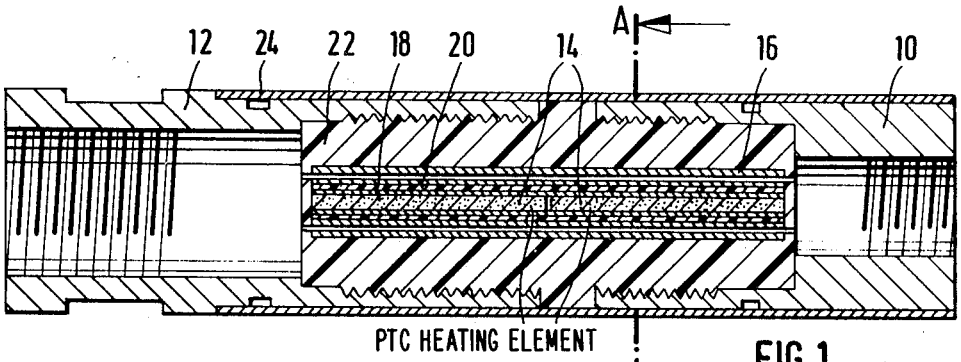
FIG. 1 is an axial section taken through a first form of embodiment of the invention.
Figure 2:
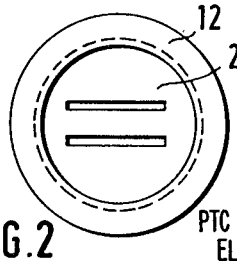
FIG. 2 is an end view of the apparatus of FIG. 1 viewed from the left.
Figure 3:
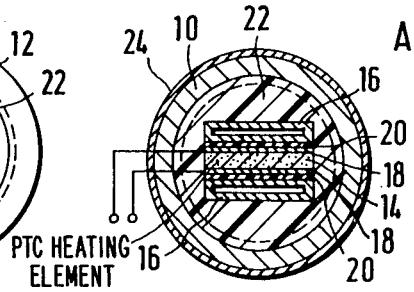
FIG. 3 is a section taken along the line A—A of FIG. 1.

A first exemplary embodiment is shown in FIGS. 1–3. The apparatus for prewarming heating oil has two metallic connector elements 10 and 12, whose cross section is adapted to the cross section of the nozzle assembly of a burner. The connector element 10 has a coaxial mount having an inner thread, into which the nozzle shank can be threaded. The connector element 12 has a mount with an inner thread into which the nozzle of the nozzle assembly can be threaded. Axial bores passing through the connector elements 10 and 12 serve to deliver the heating oil to the nozzle. Two plate-like PTC resistor elements 14 are inserted between the connector elements 10 and 12. The PTC resistor elements 14 are disposed axially adjacent one another, with their longitudinal central axis coaxial with the connector elements 10 and 12 and thus with the nozzle assembly. Ducts 16, which are embodied by flat pipes 16 preferably made of brass, are in contact with both flat sides of the PTC resistor elements 14. The flat pipes 16 connect the coaxial bores of the connector elements 10 and 12 and serve to deliver the heating oil. The width of the flat pipes 16 is equivalent to the width of the PTC resistor elements 14, so that they are in contact on their entire flat side, over a large surface area, with the PTC resistor elements 14.

Conductive coatings 18 are applied directly to the mutually opposed flat sides of the PTC resistor elements 14, serving to carry electric current and being connected via connection lines with a current source. A thin, electrically insulating layer 20 is disposed between the conductive coatings 18 and the flat pipes 16. This insulating layer 20 may be, for example, aluminum oxide applied by thermal spraying, and it has a low heat resistance.

In another realization of the invention, the electrically insulating layer 20 is a layer of plastic having a high electrical insulation value and high heat resistance. For the sake of simplicity of manufacture, a plastic film is preferably used. A polyimide film (trade name: Kapton) has proved to be particularly suitable. A film of this kind has an electrical insulation value of 280 kV/mm, a heat resistance up to 180° C. and for brief periods even up to 275° C., and high resistance to tearing. Sufficient electrical insulation can accordingly be obtained with a film thickness of only 0.1 mm. This minute thickness means there is low heat insulation and thus the desired high-quality heat transfer takes place.

The entire arrangement, comprising PTC resistor elements 14, their electric connecting lines and the flat pipes 16, is cast integrally into an insulating plastic 22 and is held coaxially in place thereby between the connector elements 10 and 12. A metallic sheath 24 pushed into place over the connector element 10 and 12 outwardly encloses the plastic and serves as an external form during casting of the plastic.

During operation, an electric current delivered via the conductive coatings 18 flows through the PTC resistor elements 14 and heats them. The oil delivered to the nozzle through the flat pipes 16 is warmed by the PTC resistor elements 14, and the current-limiting effect exhibited by the PTC resistor elements 14 as the temperature rises causes the oil to be prewarmed in a self-regulating manner to a predetermined, optimum temperature.

In the form of embodiment shown in FIGS. 1–3, the flat pipes 16 can themselves also be used to deiver electric current to the PTC resistor elements 14. The flat pies 16, to this end, need only be soldered in an electrically conductive manner to the flat sides of the PTC resistor elements 14. The connecting lines for electric current can then be soldered onto the flat pipes 16.

In this form of embodiment, it is of course necessary that the flat pipes 16 do not come into electrically conductive contact with the metallic connector elements 10 and 12 or the nozzle shank or nozzle inserted therein. To this end, the flat pipes 16 are also sealed off at either end with the insulating plastic 22 and communicate with the bores of the connector elements 10 and 12 only via bores 21 in this plastic 22.

Insofar as the following exemplary embodiments of the invention correspond to the exemplary embodiment shown in FIGS. 1–3, equivalent elements are given identical reference numerals, attention being called to the foregoing description of such elements.

Figure 4:
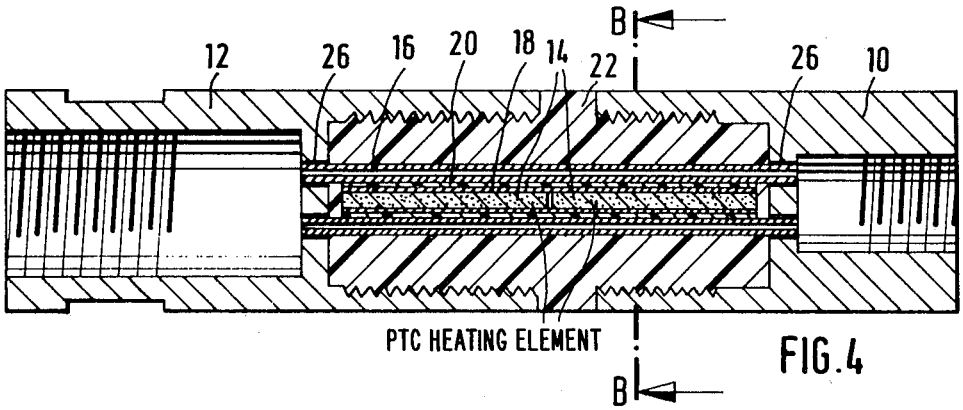
FIG. 4 is an axial section taken through a second form of embodiment of the invention.
Figure 5:
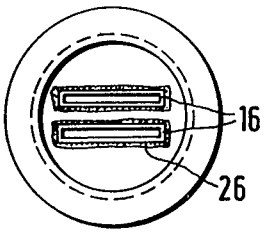
FIG. 5 is an end view of the apparatus of FIG. 4 viewed from the left.
Figure 6:
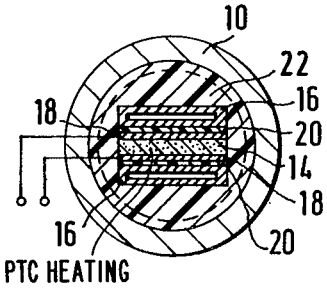
FIG. 6 is a section taken along the line B—B of FIG. 4.

In the exemplary embodiment shown in FIGS. 4–6, the connector elements 10 and 12 do not have through passages but are instead closed at their end faces oriented toward one another. The flat pipes 16 are inserted into corresponding bores passing through these closed end faces of the connector elements 10 and 12 and are soldered to them at 26.

Because in this form of embodiment the flat pipes 16 are in electrically conductive contact with the connector elements 10 and 12, carrying electric current to the PTC elements 14 via the flat pipes 16 is not possible. The delivery of current must instead always be effected via conductive coatings 18, which are separated from the flat pipes 16 by insulating layers 20.

In the form of embodiment of FIGS. 4–6, the connector elements 10 and 12 are connected and held together during manufacture by the inserted flat pipes 16, so that the integral casting of the plastic 22 is made simpler. In this form of embodiment, the sheath 24 which is pushed into place can be omitted.

Figure 7:
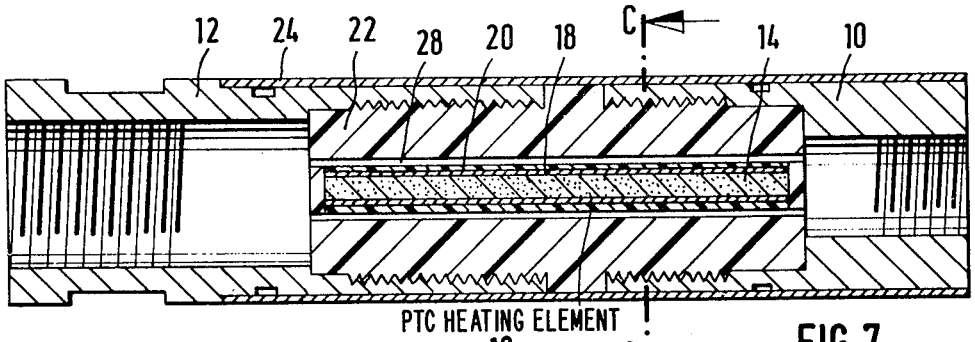
FIG. 7 is an axial section taken through a third form of embodiment of the invention.
Figure 8:
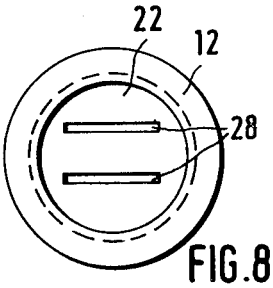
FIG. 8 is an end view of the apparatus of FIG. 7 viewed from the left.
Figure 9:
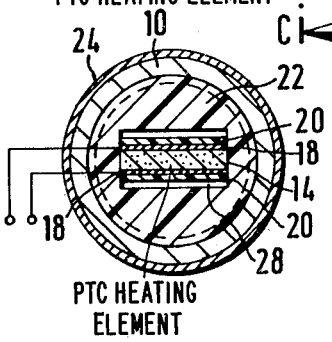
FIG. 9 is a section taken along the line C—C of FIG. 7.

In the third form of embodiment shown in FIGS. 7–9, flat pipes 16 are not used. At both flat sides of the PTC resistor element 14, flat ducts 28 are blocked out in the plastic 22. The width of these ducts 28 is equivalent to the width of the PTC resistor element 14. The ducts 28 are blocked out during the integral casting of the plastic 22. Instead of flat ducts 28, bores which lie quite closely adjacent one another can be provided in the plastic, which cover the flat sides of the PTC element 14 completely.

The supply of electric current to the PTC resistor element 14 takes place via conductive coatings 18, which are protected by an insulating layer 20 from the oil flowing immediately past them. In this form of embodiment, a sheath 24 pushed into place is also provided, which essentially serves the purpose of fixing the connector elements 10 and 12 in position during the plastic casting process.

In FIG. 7, only one PTC resistor element 14 is shown. Naturally, as in the preceding embodiments, two or more PTC resistor elements 14 can also be disposed axially adjacent one another. The number of PTC resistor elements 14 is essentially determined by the required heat output, or in other words by the oil throughput.

Figure 10:
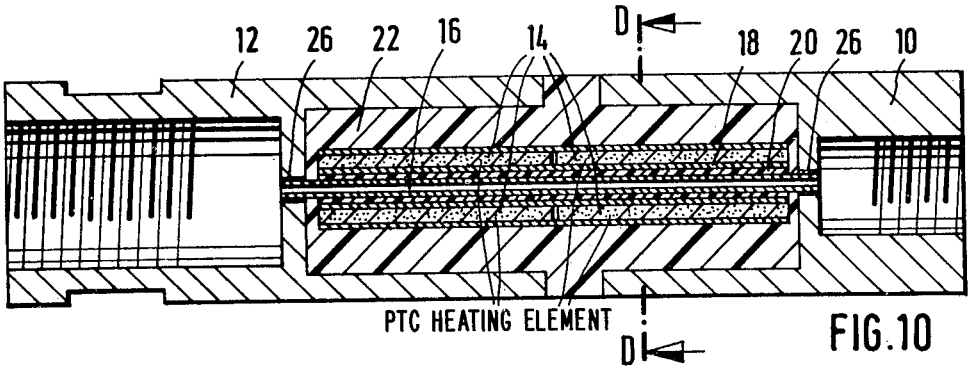
FIG. 10 is an axial section taken through a fourth form of embodiment of the invention.
Figure 11:
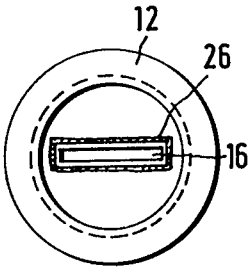
FIG. 11 is an end view of the apparatus of FIG. 10 viewed from the left.
Figure 12:
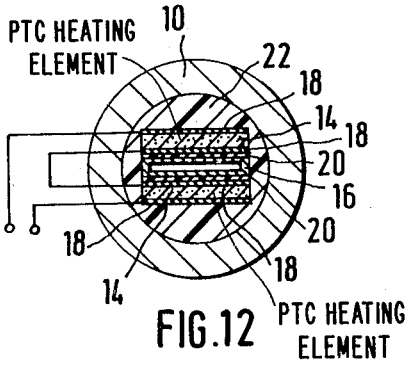
FIG. 12 is a section taken along the line D—D of FIG. 10.

In the fourth exemplary embodiment shown in FIGS. 10–12, a single flat pipe 16 is provided, which is disposed with its longitudinal central axis coaxial with the connector elements 10 and 12. As in the exemplary embodiment of FIGS. 4–6, the flat pipe 16 is soldered into appropriate bores in the closed end faces of the connector elements 10 and 12.

Two PTC resistor elements 17 each, disposed axially adjacent one another, rest against the associated opposing walls of the flat pipe 16. Thus, the heating of the oil flowing through the flat pipe 16 is effected by means of four PTC resistor elements 14 in all.

The PTC resistor elements 14 disposed at either side of the flat pipe 16 are preferaby disposed in series one after another. This can be done by means of an electric line embedded in the plastic 22, which connects the conductive coatings oriented toward the flat pipe 16 with the PTC resistor elements 14.

The opportunity also exists of connecting the PTC resistor elements 14 directly to the flat pipe 16 in an electrically conductive manner, so that the flat pipe 16 itself represents the conductive connection for the series disposition of the PTC resistor elements 14. In this case, naturally the flat pipe 16 must not be soldered into the connector elements 10 and 12, but must instead be insulated electrically from them by the plastic 22, in the manner described above in connection with the exemplary embodiments of FIGS. 1–3.

The form of embodiment of FIGS. 10–12 is particularly suitable for applications in which high heating output is required but where the axial length of the apparatus must not be increased.

Figure 14:
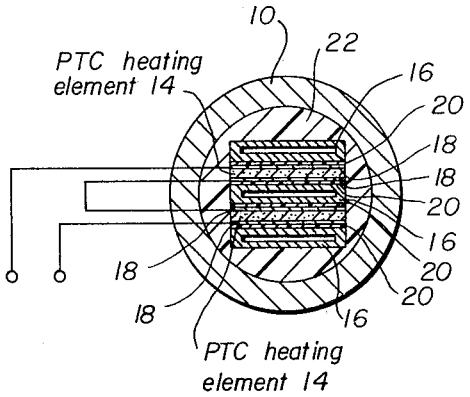
FIG. 14 is a variant of the form of embodiment of FIGS. 10 and 12.

Further variants of the embodiment form shown in FIGS. 10–12 are readily apparent. For instance, further flat pipes 16 can be disposed at the outer flat sides of the PTC resistor elements 14, in order to enlarge the oil flowthrough cross section as shown in FIG. 14.

Figure 13:
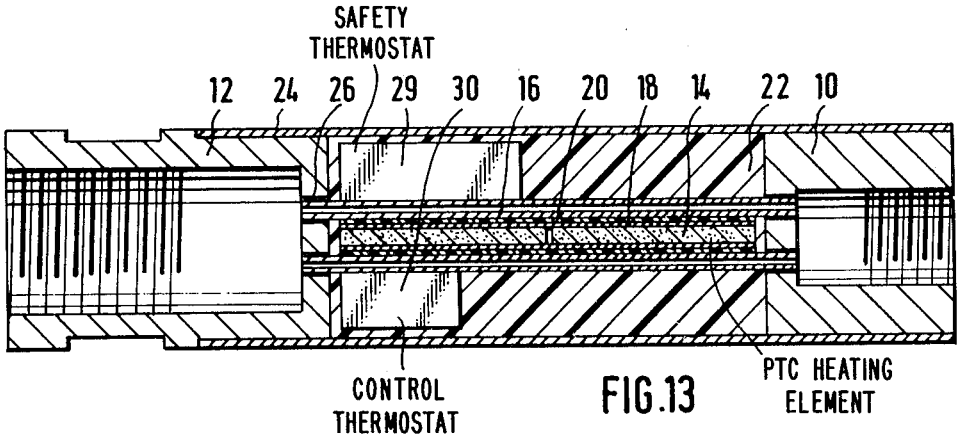
FIG. 13 is a varient of the form of embodiment of FIG. 4.
Figure 15:
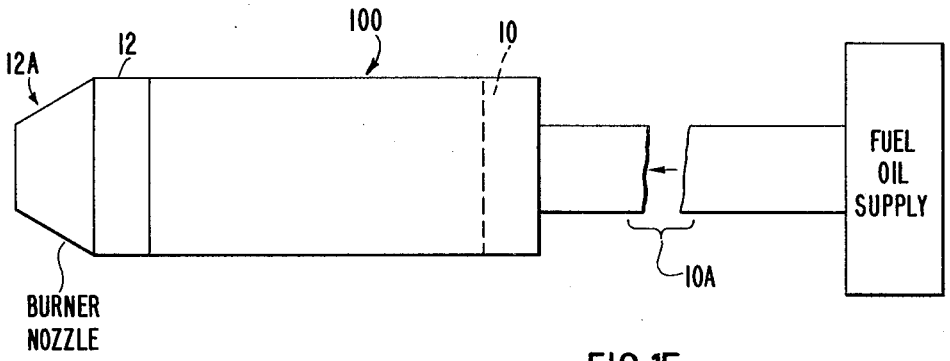
FIG. 15 represents a prior art type of nozzle assembly which incorporates different forms of preheaters in accordance with the invention.

The exemplary embodiment of FIG. 13 corresponds fundamentally in its structure to the exemplary embodiment of FIGS. 4–6. In addition, however, a safety thermostat 29 is mounted here on the outer (in the drawing, the upper) flat side, remote from the PTC resistor elements 14, of the one flat pipe 16. The safety thermostat 29, which may be of a conventional type such as a bimetallic thermostat, is in contact over a large surface area with the flat side of the flat pipe 16, so that good heat transfer is assured between the flat pipe 16 and the safety thermostat 29.

The safety thermostat 29 is disposed in series with the electrical circuit of the PTC resistor elements 14 and breaks this circuit as soon as it has reached a predetermined maximum temperature. This predetermined maximum temperature is somewhat lower than the maximum permissible temperature set for prewarming of the heating oil, which is fixed at 95° C. on the basis of safety regulations. This difference between the maximum permissible oil temperature, for instance, 95° C., and the response temperature of the safety thermostat 29 takes into account the time lag, resulting from heat capacity and heat conduction, with which the safety thermostat 29 assumes the temperature of the PTC resistor elements 14.

On the outer flat side of the other flat pipe 16 (the lower flat side in the drawing), there is a control thermostat 30, in contact over a large surface area in the same manner. This control thermostat, as well, may be of a conventional type. The control thermostat 30 is switched into the control circuit of the burner and it activates the burner upon the attainment of a predetermined temperature of 60° C., for example, so that the burner can be ignited. If the temperature then drops back below a predetermined value, 40° C., for example, the control thermostat 30 turns the burner off. As a result, both uneconomical ignition of the burner at an excessively low oil temperature and sooting resulting from an excessively low oil temperature during burner operation are prevented.

The safety thermostat 29 and the control thermostat 30 also fit into the cross section of the connector elements 10 and 12 and thus into the cross section of the nozzle assembly. The thermostats 29 and 30 are also cast integrally into the insulating plastic 22.

It is common to all forms of embodiment that the apparatus is one whose cross section, and accordingly the outer circumference, correspond to the cross section and outer circumference of the nozzle assembly, so that this apparatus can be inserted into the nozzle assembly without it being necessary to alter the geometry or the dimensions of the nozzle assembly or of the burner. It is furthermore common to all the forms of embodiment that the oil is carried directly past the PTC resistor elements in such a manner as to involve large heat-exchange surface areas, so that an optimal level of effectiveness and minimal inertia in prewarming the heating oil are maintained. Despite the large heat-exchange surface area, the oil does not come into direct contact with the PTC resistor elements, so that the oil cannot react chemically with the PTC resistor material.

Finally, all the forms of embodiment can be produced from a small number of simple parts, in a manner which is simple from both the manufacturing and the assembly standpoints.

It is to be understood that the foregoing description of preferred embodiments is given entirely by way of illustrative example and that numerous variants of the invention may be described without departing from the scope of the invention as defined in the appended claims.

What is claimed is:

1. In an oil burner system having a burner nozzle connected to a supply of fuel oil by a nozzle assembly incorporating a heater for prewarming the fuel fed to the nozzle, the improvement wherein said nozzle assembly comprises an elongated casing means having a first connector means at one end thereof directly connected to said nozzle and a second connector means at its other end directly connected to a conduit receiving oil from said supply of fuel, said preheater means comprising, an elongated rectangularly shaped PTC heating resistor in said casing means for the automatic controlled preheating of fuel oil received from said supply of fuel, said PTC resistor having a pair of parallel sides of greater width than the thickness of said resistor, coextensive electrical contact means extending longitudinally and transversely in electrical engagement with said parallel sides, electric connecting means attached to said contact means for supplying electrical power thereto, heat transfer means in said casing means for transferring heat from said PTC resistor to oil flowing in said casing means, said heat transfer means including flattened parallel metal thin wall conduit sections extending between said first and second connectors and defining thin generally rectangular cross section flow paths for oil flowing through said casing means from said source of oil to said nozzle, said conduit sections extending coextensively with and sandwiching said PTC resistor therebetween, a thin layer of electrical insulation material being interposed between said resistor and said conduit sections, said conduit sections being in effective heat transmitting relation to said PTC resistor parallel sides with said conduit sections having said flattened surfaces thereof parallel to and facing said parallel sides of said resistor and in direct heat conductive relationship thereto through said thin insulation layer therebetween, and said parallel conduit section flow paths having smooth unimpeded cross sections to facilitate the flowing of oil uniformly therethrough.

* * * * *